US007520788B1

(12) United States Patent
Gonzalez

(10) Patent No.: US 7,520,788 B1
(45) Date of Patent: Apr. 21, 2009

(54) RECIPROCATING OAR WITH PROPULSION REVERSING SYSTEM

(75) Inventor: Gustavo Gonzalez, 7559 NW. 174th Ter., Hialeah, FL (US) 33015-7146

(73) Assignee: Gustavo Gonzalez, Miami, FL (US)

( * ) Notice: Subject to any disclaimer, the term of this patent is extended or adjusted under 35 U.S.C. 154(b) by 88 days.

(21) Appl. No.: 11/863,681

(22) Filed: Sep. 28, 2007

(51) Int. Cl.
*B63H 1/30* (2006.01)
*B63H 16/04* (2006.01)
*B63H 16/08* (2006.01)
*B63H 16/10* (2006.01)
*B63H 16/18* (2006.01)

(52) U.S. Cl. ..... 440/17; 440/20; 440/101; 440/104; 416/82

(58) Field of Classification Search ..... 440/13–32, 440/101–110; 416/79–83
See application file for complete search history.

(56) References Cited

U.S. PATENT DOCUMENTS 226,957 A * 4/1880 Barnes ..... 440/19
791,852 A * 6/1905 Worcester ..... 416/82
3,003,457 A * 10/1961 Patterson ..... 440/17
3,122,122 A * 2/1964 Jenkins ..... 440/19
3,757,729 A * 9/1973 Golden ..... 440/19
3,967,574 A * 7/1976 Golden ..... 440/20
4,043,291 A * 8/1977 Bearup et al. ..... 440/20

FOREIGN PATENT DOCUMENTS

JP 2002012197 A * 1/2002

* cited by examiner

*Primary Examiner*—Ajay Vasudeva

(57) ABSTRACT

A manually-operable reciprocating rowing system having a reversible oar for forward or reverse propulsion. The oar has a plurality of pivoting blades mounted in a housing and movable between open and closed positions with each stroke of the oar. In the open position, the blades are positioned to allow water passage through the housing, while in the closed position, the blades are positioned to obstruct water passage through the housing. Gates are provided for stopping the pivoting movement of the blade at the blade housing. A reversing mechanism selectively pivots the gates to allow the blades to pass from one side to an opposite side of the housing, thereby allowing propulsion in a reversed direction.

9 Claims, 7 Drawing Sheets

RECIPROCATING OAR WITH PROPULSION REVERSING SYSTEM

BACKGROUND

1. Field of Invention

This invention relates to a forward facing rowing system, suitable to use in the sit-down or stand-up position.

2. Description of Prior Art

The current systems to row forwards present many physical demands on the rower such as expounded motor skills coordination and great force output which cause some to steer away from this sport. After each power stroke one needs the same energy and flexibility in order to reach the recovery phase, not to mention the great difficulty it takes to change of direction (to restrain or to back down), or even to turn in any direction.

Current forward facing rowing systems are limited to a sitting position and do not offer the ability to row while standing. These existing systems are rigid in the sense that the rower must comply to the mechanism in order to row and are intended for rowers that meet certain physical and athletic criteria; thus, excluding those lacking physical dexterity.

The majority of these forward rowing mechanisms must use a boat that meets the specific dimensions of their structure. They are not usable in boats of different dimensions, and usually require one purposeful set of oars to be used in said vessel. Furthermore, these present systems in use require that alterations be made to the boat either to the sidewall or the deck in order to install them.

The current equipments to row occupy a lot of room inside and outside the structure of the vessel, hence preventing more rowing participants to join in within the same boat. These present systems make it difficult for boats to maneuver in close spaces or heavily trafficked areas.

OBJECTS AND ADVANTAGES

This forward rowing system, which allows one to row sitting or standing, facilitates the rowing action because it requires a single uniform movement of the handlebar to do it efficiently, forwards or backwards. With this system the oars do not need to leave the surface of the water and they move to the rowing power position without much effort. Anyone can row standing up due to the adjustable handlebar. The movement is the same either forward or backward.

The mechanism conforms to the boat and rower by adjusting it to the width and the height of the boat. Clamps are used in order to fasten the oars to the boat without altering the sidewall of the boat, that's why they can be used on boat of different dimensions. Moreover, it allows for an extra set of oars to be installed in the same boat in order to allow more rowers to participate.

Last, and not least, this forward facing rowing system occupies very little space inside and outside the boat. Several rowers can participate in the same boat and can maneuver it with ease-ability in close spaces or in heavily trafficked areas.

SUMMARY OF THE INVENTION

An innovative new system to row forward with the oars always submerged saving one the effort of raising and lowering the oars out of and into the water in order to row.

Yet another novel aspect is the handlebar that allows the oscillating movement to be uniform, facilitating any person to row without previous training and with little effort. The oars follow an oscillating movement that is vertically parallel to the boat and occupy very little lateral space, which facilitates the individual to maneuver in reduced spaces or heavy traffic.

For greater efficiency, this system allows one to reverse direction, to stop or to slow down, due to a lever located near each handgrip shaft. With just the ease of a thumb movement to this lever, rowing direction is easily reversed. Because of the unobtrusiveness of the mechanism it is possible to install more oar assemblies in the same boat.

Furthermore, it must be emphasized that the person can row in a sit-down or stand up position, the handlebar is intended for such a whim.

The frame of the system has the capability of horizontal and vertical adjustment to comply with each person's needs; the support block can be adjusted vertically and the axis can be adjusted horizontally.

This system is so easy to install that one needs only to clamp it to the boat/vessel without any need to amend the boat's sidewall.

BRIEF DESCRIPTION OF THE DRAWINGS

FIG. 6 B shows a perspective view of locking mechanism in open position.

REFERENCE NUMERALS IN DRAWINGS

Figure 2:
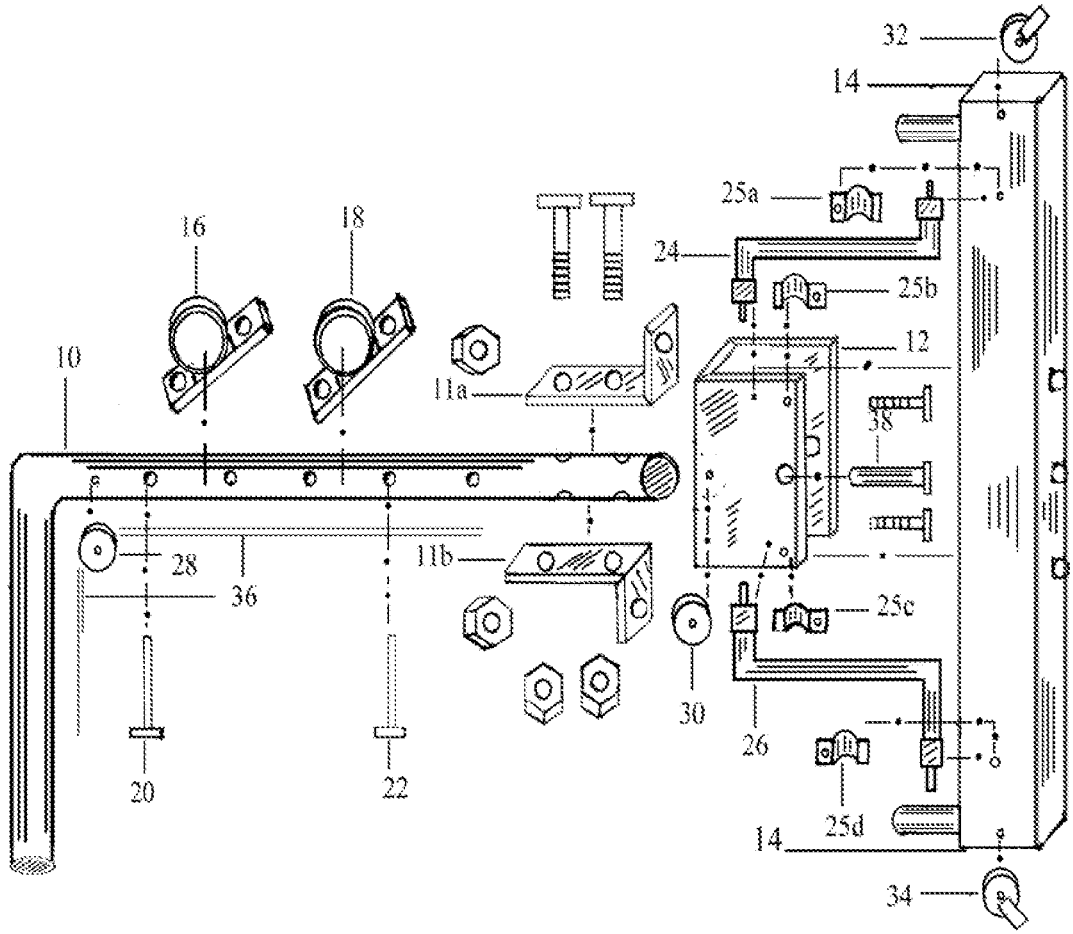
FIG. 2 shows an exploded view of axis, case and handlebar assembly.
Figure 4:
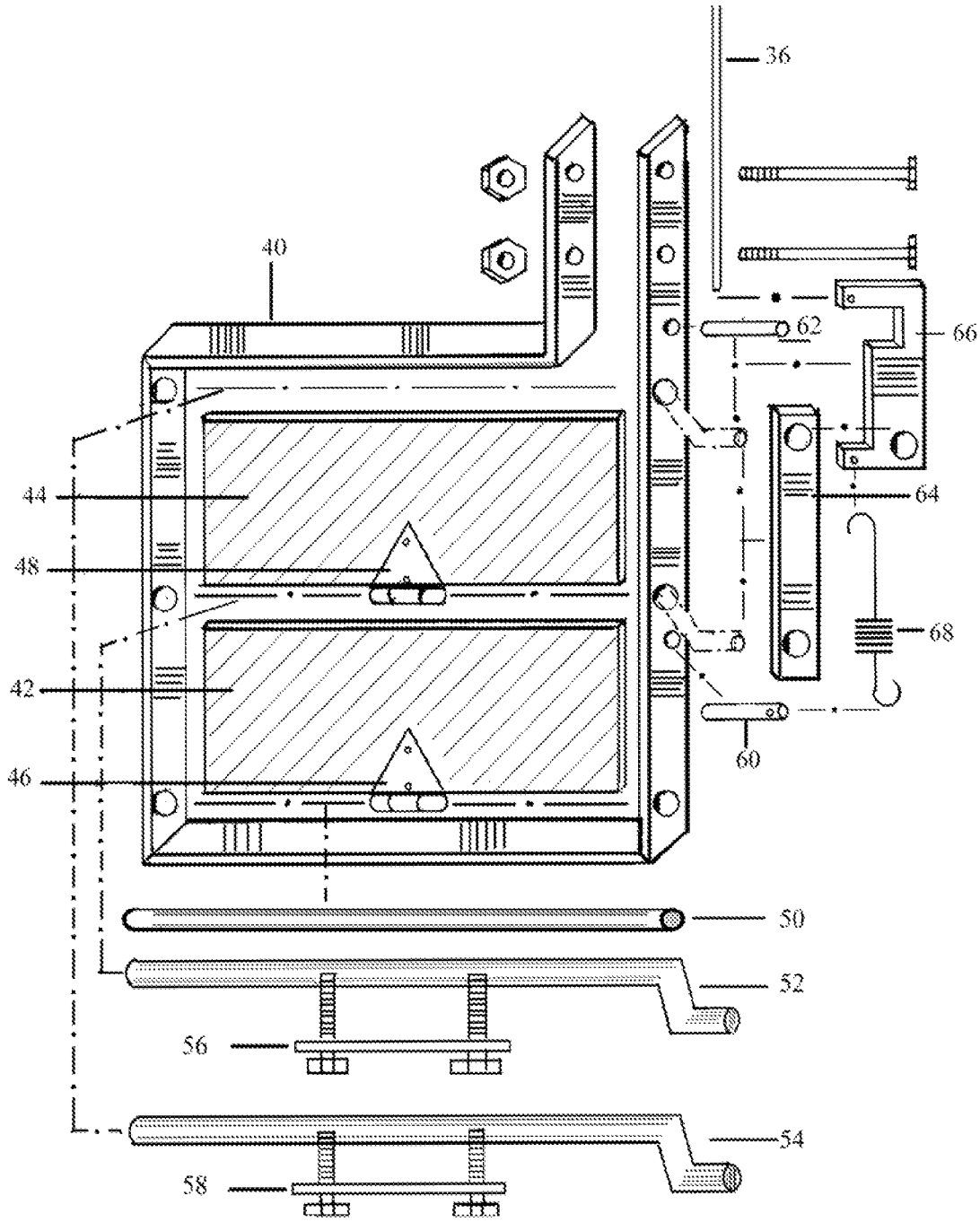
FIG. 4 shows an exploded view of oar mechanism, housing, blades and gates.

| | |
|---|---|
| FIG. 2 | |
| 10 | FRAME |
| 11a | PLATE |
| 11b | PLATE |
| 12 | CASE |
| 14 | HANDLEBAR |
| 16 | BALL-BEARING |
| 18 | BALL-BEARING |
| 20 | PIN |
| 22 | PIN |
| 24 | FLEXIBLE CABLE. |
| 25a, b, c, d | CABLE-CLAMP |
| 26 | FLEXIBLE CABLE |
| 28 | PULLEY |
| 30 | PULLEY |
| 32 | LEVER |
| 34 | LEVER |
| 36 | CABLE |
| 38 | PIN |
| FIG. 4 | |
| 40 | HOUSING |
| 42 | BLADE |
| 44 | BLADE |
| 46 | HINGE |
| 48 | HINGE |
| 50 | AXIS |
| 52 | AXIS-LEVER |

-continued

Figure 5:
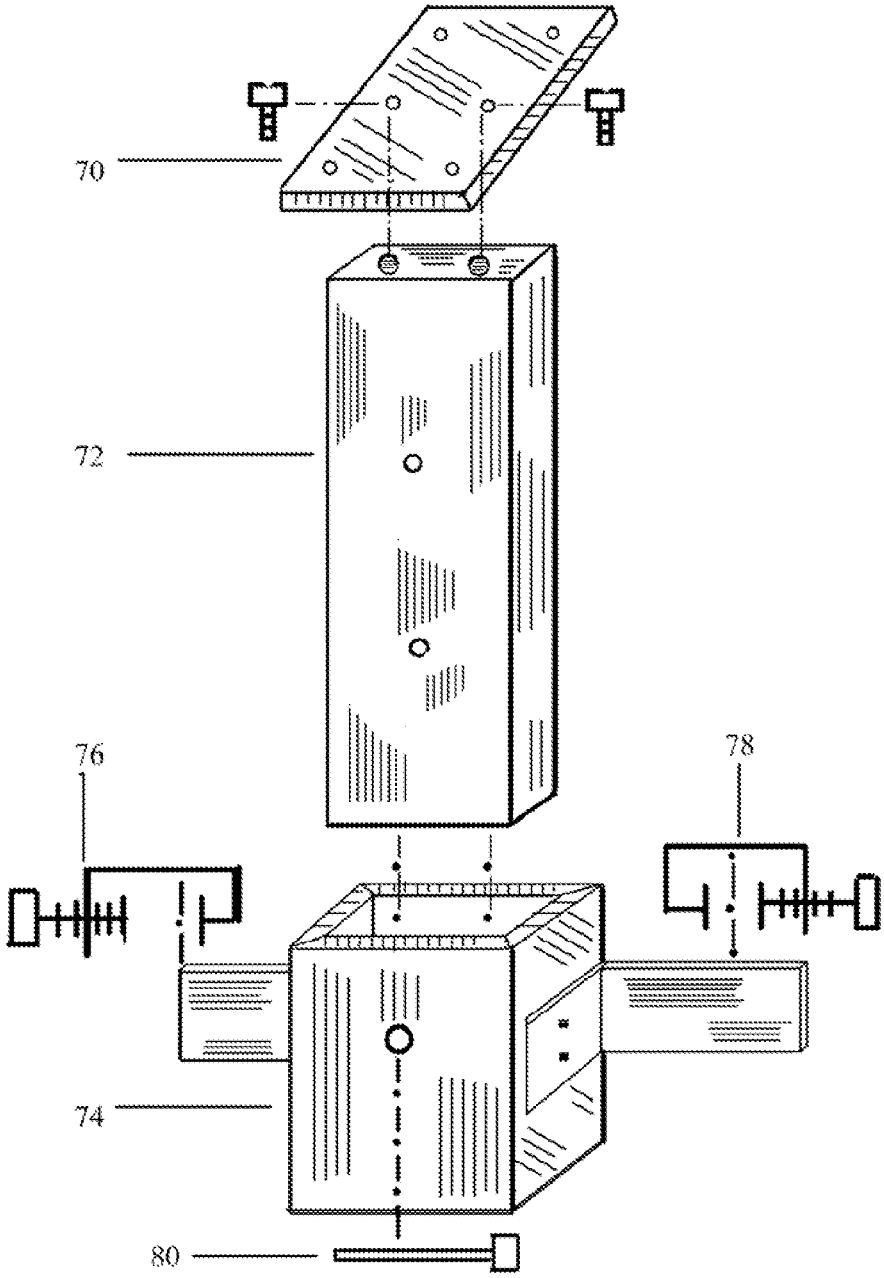
FIG. 5 shows a perspective view of mounting plate, supporting block, and gunwale attachment base.

| | |
|---|---|
| 54 | AXIS-LEVER |
| 56 | GATE |
| 58 | GATE |
| 60 | PIN |
| 62 | PIN |
| 64 | CONNECTING ROD |
| 66 | LOCKING ROD |
| 68 | SPRING |
| FIG. 5 | |
| 70 | PLATE |
| 72 | BLOCK |
| 74 | BASE |
| 76 | CLAMP |
| 78 | CLAMP |
| 80 | PIN |

Descriptions-FIG. 1 to 7

Figure 1:
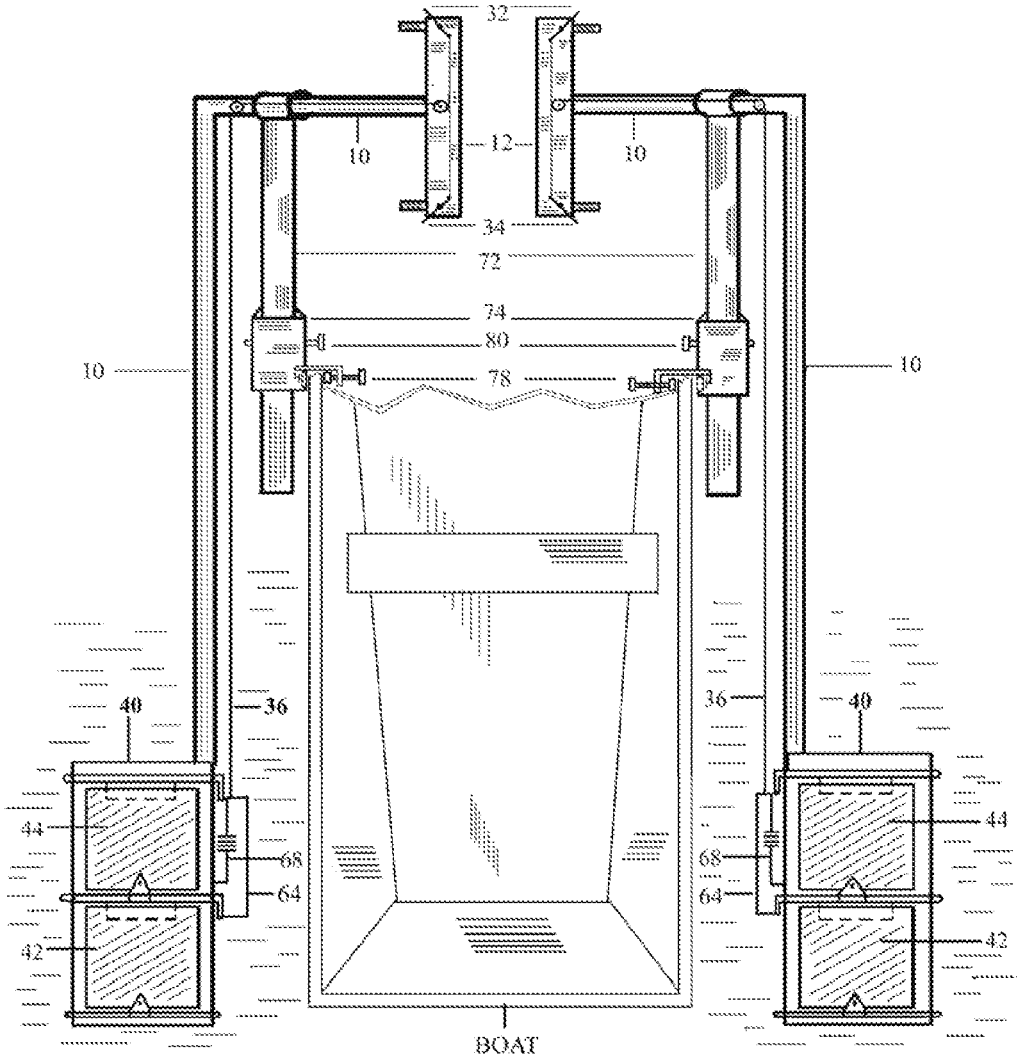
FIG. 1 shows a top perspective view of the rowing mechanism.

FIG. 1 shows a top perspective view of rowing system, its location on each side of the boat, the assembly of block 72 and base 74, the engagement cable between levers 32 and 34 on handlebar 12, and lever system on housing 40.

FIG. 2 shows an exploded view of the axis and handlebar. The horizontal loom of frame 10 is an axis attached to case 12 by plates 11*a* and 11*b*. Case 12 holds a handlebar 14 with a pin 38 crossing case 12 and eye-bolt attached to handlebar 14. This axis 10 goes inside ball-bearings 16 and 18. The vertical arm of frame 10 is an oar loom. A cable 36 comes from oar housing 40, shown on FIG. 4, through a pulley 28 and connects with flexible cables 24 and 26 through a pulley 30 located on case 12. The flexible cables have inner cables, like the one used on a bike's brakes. Flexible cable 24 is fixed at one end on handlebar 14 by cable-clamp 25*a*. The inner cable is attached at lever 32. The other end of flexible cable 24 is fixed at case 12 by cable-clamp 25*b*. The inner cable is tied up to cable 36 through bottom side or pulley 30. Flexible cable 26 is fixed at one end to handlebar 14 by cable-clamp 25*d*, the inner cable is attached at lever 34. The other end of flexible cable 26 is fixed at case 12 by cable-clamp 25*c*, the inner cable is tied up at cable 36 through upper side of pulley 30.

Figure 3:
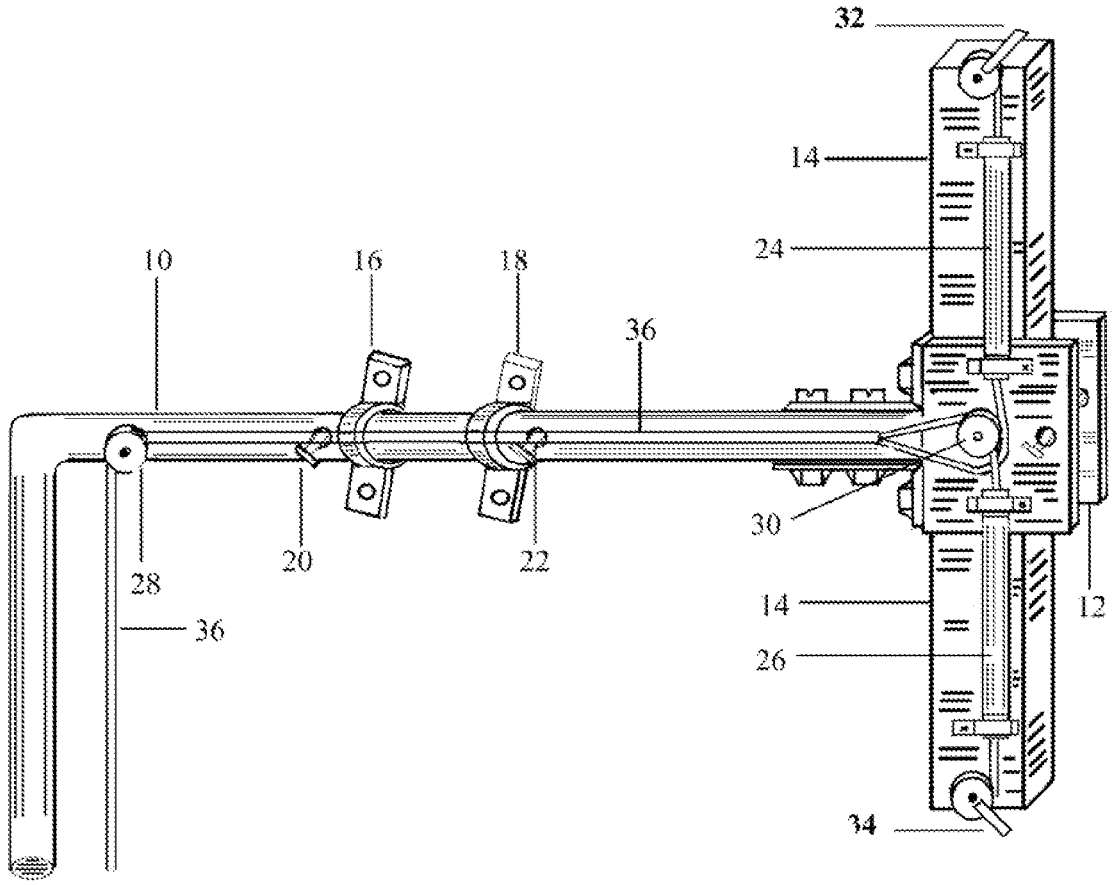
FIG. 3 shows a perspective view of axis, case, and handlebar, as shown in FIG. 2, assembled.

FIG. 3 shows a perspective view of frame 10, its assembly with ball-bearings 16 and 18, its connection with case 12, and the junction between case 12 and handlebar 14.

FIG. 4 shows an exploded view of oar mechanism. Housing 40 is attached to vertical arm loom of frame 10, and holds axis 50, axis-lever 52, and axis-lever 54. Axis 50 holds hinge 46 attached to blade 42. Axis-lever 52 holds hinge 48 attached to blade 44, and gate 56. Axis-lever 54 holds gate 58. Axis-lever 52 and axis-lever 54 are bended in one end 90 degrees and these sections are bended again 90 degrees outward forming levers. These levers are connected by connecting rod 64. Axis-lever 54 holds a locking rod 66 attached to pin 60 by spring 68. The opposite section of locking rod 66 is connected to cable 36. A notch on locking rod 66 locks it on pin 62 by the action of spring 68.

FIG. 5 shows a perspective view of mounting plate 70, supporting block 72, base 74 and clamps 76 and 78. Plate 70 holds together block 72 and ball-bearings 16 and 18 on frame 10, shown in FIG. 2. Base 74 is a container open at the bottom. It holds block 72 in a fixed position by pin 80. Pin 80 goes through a pin-hole of base 74 and any one of the pin-holes of block 72. Clamps 76 and 78 fix the base 74 to the sidewall of the boat.

FIG. 6 A is a perspective view of the stopping mechanism in the closed position. The spring 68 holds the locking rod 66 on pin 62 and connecting rod 64 at the down position, keeping the gates 56 and 58 in stop position.

FIG. 6 B is a perspective view of the locking rod 66 disengaged from pin 62; connecting rod 64 and axis-levers 54 and 52 stay in the up position by the action of cable 36, keeping the gates 56 and 58 open until the rower releases the levers 32 or 34 located on handlebar, as shown in FIG. 3.

Figure 7:
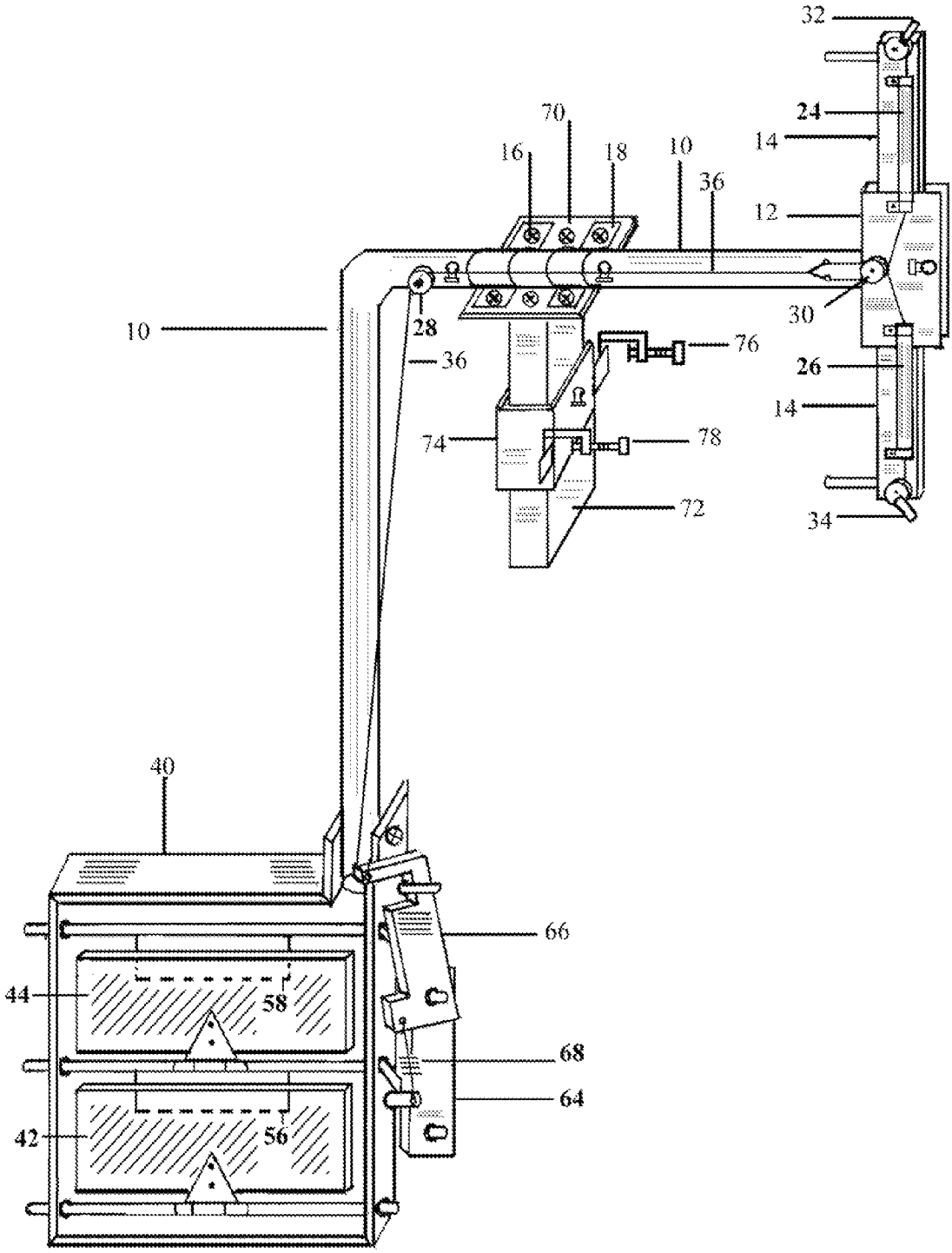
FIG. 7 shows a perspective view of one assembled mechanism.

FIG. 7 is a perspective view of one oar assembly. It shows the connection between ball bearings 16 and 18, the plate 70 and the base 74. Frame 10 is the connector between handlebar 14 and housing 40. Cable 36 and flexible cables 24 and 26 are the engagement of levers 32 and 34 on handlebar 14, and locking-rod 66 on housing 40, through the pulleys 28 and 30.

Operation:

Adjustments for Different Fitness Levels

Height Adjustment

One chooses the location on the boat for the oar assembly mechanism and secure base 74 with clamps 76 and 78 to boat's sidewall, then slips block 72 into base 74; one sets the height aligning the pin-holes of base 74 and one of the pin-holes of block 72. One inserts pin 80 into the pin-holes. FIG. 7 shows 2 pin-holes in block 72, this is just for illustration; it could be more than 2 pin-holes. These procedures apply to oar assembly on the boat's opposite side.

Width Adjustment

Frame 10 is loose inside ball-bearings 16 and 18. One moves frame 10 to the desire position, according to boat's width, then inserts pins 20 and 22 on frame 10 at sides of plate 70, attached at ball-bearings 16 and 18 on one side and to block 72 on the other side.

Handlebar Adjustment

One places handlebar 14 on case 12, selecting the desired position of handlebar 14, then one aligns pin-holes of case 12 with one eye-bolt of handlebar 14, inserting pin 38 into pin-holes. Flexible cables 24 and 26 are long enough to reach any position of handlebar 14. FIG. 2 shows 3 eye-bolts on handlebar 14, this is just for illustration; it could be more than 3 eye-bolts.

Rowing Operation

Figure 6A:
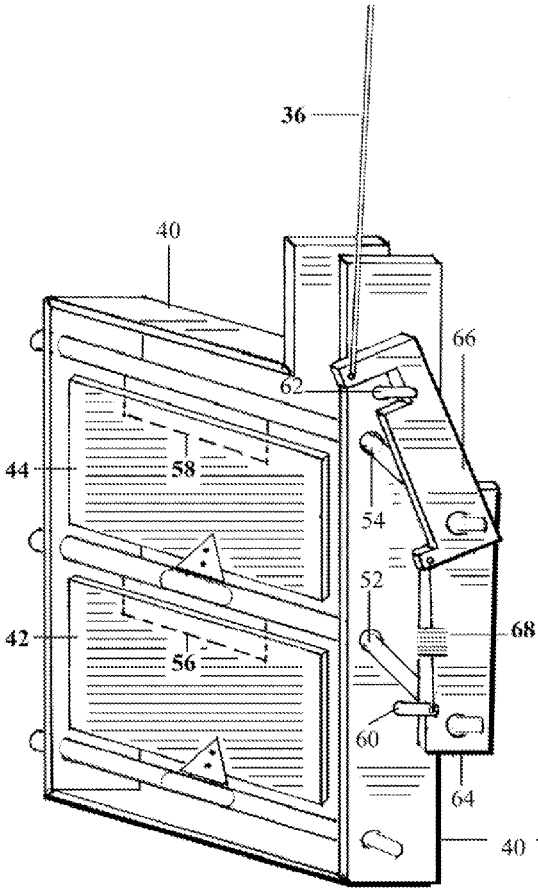
FIG. 6 A shows a perspective view of locking mechanism in closed position.
Figure 6B:
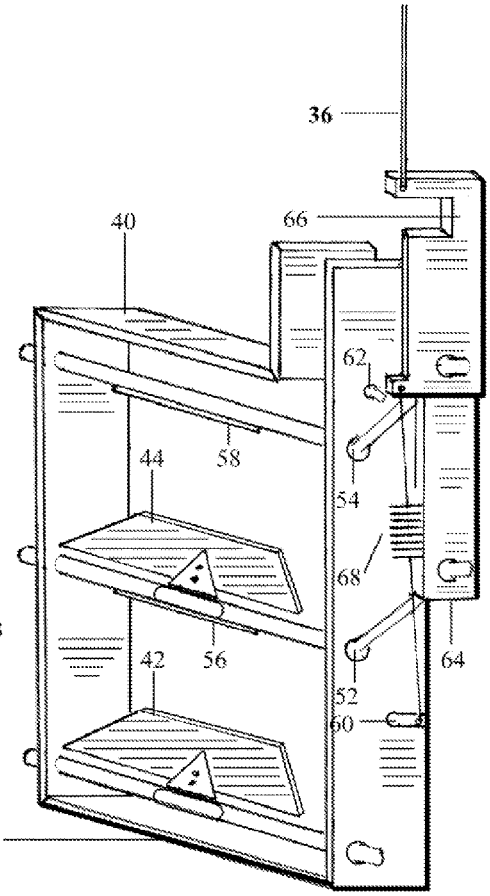

To select a direction of propulsion, a user grasps the handgrip located on the handlebar 14 and moves lever 32 or 34, according to user's standing or sitting position. This action on the lever 32 or 34 is transferred to the flexible cable 24 or 26 and cable 36, which unlocks and pulls the locking rod 66 and the connecting rod 64. The levers 52 and 54 rotate 90 degrees and correspondingly move gates 56 and 58 attached to them to an open position, as shown in FIG. 6B. This allows the user to selectively position the blades 42 and 44 on one side of the housing. Once the blades 42 and 44 are positioned on a selected side, the user releases the lever 32 or 34 to move gates 56 and 58 to a closed position. At this moment, spring 68 resets the connecting rod 64 and the locking rod 66 to a closed position, securing the locking rod 66 on the pin 62, as shown in FIG. 6A.

The blades 42 and 44 are free to swing back and forth with each stroke of the oar. When the handlebar 14 is pulled back, the vertical loom of frame 10 swings in a pivotal motion, dragging housing 40 forward. Blade 42 hinged on axis 50 and blade 44 hinged on axis-lever 52 are moved by water resistance toward the housing and stop at gates 56 and 58. In this position, the blades 42 and 44 are positioned to obstruct water passage through the housing 40, which allows the oar to deliver a power stroke. When the handlebar 14 is pushed forward, the vertical loom of frame 10 drags the housing 40 rearward. Blade 42 hinged on axis 50 and blade 44 hinged on axis-lever 52 are moved by water resistance away from the gates 56 and 58. In this position, the blades 42 and 44 are positioned to allow water passage through the housing 40. This reciprocating action of the oar propels the boat forward. FIG. 4 shows two blades 42 and 44. However, the oar can have more than two blades.

A reversing mechanism pivots the gates 56 and 58 to allow blades 42 and 44 to pass from one side to the opposite side of the housing 40, thereby allowing propulsion in a reversed direction. In a sit-down position, the user grasps handgrip shaft located on handlebar 14 and pulls lever 34, which pushes gates 56 and 58 to an open position. The user can alternatively pull lever 32 in the standing-up position. While still holding or pulling the lever 32 to maintain the gates 56 and 58 in the open position, the user then pulls handlebar 14 backward, which moves the blades 42 and 44 past the gates 56 and 58 to the opposite side of the housing 40. After the blades 42 and 44 are moved to the opposite side of the housing 40, the user releases the lever 34 to move gates 56 and 58 to a closed position. This action resets the rowing system for a reverse propulsion.

Maneuvering (Turning and Stopping):

The turning around action is done with one oar in forward position and the other one in backward position, one hand pushing handlebar 14 of rowing mechanism of one side of the boat, and the other hand pulling handlebar 14 of rowing mechanism of the other side of the boat at the same time in a push-pull action. Stopping is done with both oars in the backward position.

What is claimed is:

1. A marine reciprocating oar with a propulsion reversing mechanism, comprising:

an elongate oar shaft having first and second shaft portions, the first shaft portion being contiguous with and extending substantially perpendicularly relative to the second shaft portion, the oar shaft configured for a reciprocating movement between forward and reverse oar strokes;

a mounting arrangement configured for rotatably mounting the oar shaft on a sidewall of a boat;

a handle bar disposed at an end of the first shaft portion;

a blade housing having an opening and disposed at an end of the second shaft portion, the blade housing extending substantially in a plane to define a first side and an opposing second side of the blade housing;

a plurality of blades pivotally movable between an open position and a closed position with each stroke of the oar, each blade pivotally attached to the blade housing by a hinge disposed at a lower edge of the respective blade and pivotable about an axis substantially perpendicular to the second shaft portion, wherein in the closed position the blades are positioned to substantially block the opening of the housing to obstruct water passage therethrough, and wherein in the open position the blades are positioned to substantially unblock the opening of the housing to allow water passage through the housing;

a plurality of gates pivotally attached to the blade housing, the gates being configured for selectively stopping the pivoting movement of the blade at the blade housing or allowing the blades to pass from one of the sides of the housing to the opposing one the sides of the housing; and a reversing mechanism for reversing the propulsion direction of the oar, the reversing mechanism comprising at least one lever connected to the gates by a cable, the lever being operable to selectively pivot each gate to allow the blades to reverse the direction of propulsion.

2. The propulsion oar of claim 1, wherein the reversing mechanism further comprises a gate locking rod connected to the cable, and a connecting rod pivotally attached to the gate locking rod.

3. The propulsion oar of claim 2, wherein the reversing mechanism further comprises a spring attached at one end to the locking rod.

4. The propulsion oar of claim 1, wherein the at least one lever comprises two levers.

5. The propulsion oar of claim 1, wherein the mounting arrangement further comprises a supporting block pivotally attached to the oar shaft, and a base configured to be clamped to a sidewall of a boat, wherein the base is configured for holding the supporting block.

6. The propulsion oar of claim 5, wherein the base comprises a housing with an open bottom and a plurality of holes, the base further comprising a pin for securing the supporting block inside the base to adjust the height of the base.

7. The propulsion oar of claim 1, wherein the handle bar is an elongated arm attached at its middle to the oar shaft, an upper portion of the handle bar configured for rowing in a standing position and a bottom portion of the handlebar configured for rowing in sit down position.

8. The propulsion oar of claim 1, wherein the oar shaft can be slidably adjusted in the mounting arrangement for adjusting the lateral position of the oar relative to a sidewall of the boat.

9. The propulsion oar of claim 1, wherein the housing is a rectangular frame.

* * * * *